US010273957B2

(12) United States Patent
Furuya et al.

(10) Patent No.: US 10,273,957 B2
(45) Date of Patent: Apr. 30, 2019

(54) TWO-CYLINDER HERMETIC COMPRESSOR

(71) Applicant: Panasonic Intellectual Property Management Co., Ltd., Osaka-shi, Osaka (JP)

(72) Inventors: Shiho Furuya, Kyoto (JP); Hideyuki Horihata, Shiga (JP); Hiraku Shiizaki, Shiga (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 142 days.

(21) Appl. No.: 15/427,899

(22) Filed: Feb. 8, 2017

(65) Prior Publication Data

US 2017/0248139 A1 Aug. 31, 2017

(30) Foreign Application Priority Data

Feb. 26, 2016 (JP) ..... 2016-035037

(51) Int. Cl.
*F04C 23/00* (2006.01)
*F04C 29/00* (2006.01)
(Continued)

(52) U.S. Cl.
CPC ..... *F04C 23/001* (2013.01); *F01C 21/02* (2013.01); *F01C 21/108* (2013.01);
(Continued)

(58) Field of Classification Search
CPC .. F04C 23/001; F04C 23/008; F04C 29/0021; F04C 18/3564; Y10S 417/902
See application file for complete search history.

(56) References Cited

U.S. PATENT DOCUMENTS 2,988,267 A * 6/1961 Kosfeld ..... F25B 31/002 417/410.3
4,640,669 A * 2/1987 Gannaway ..... F04C 23/008 184/6.16

(Continued)

FOREIGN PATENT DOCUMENTS

JP 2008-014150 1/2008
WO 2016/017281 A1 2/2016

OTHER PUBLICATIONS

The Extended European Search Report dated Aug. 7, 2017 for the related European Patent Application No. 17153366.4, 8 pages.

*Primary Examiner* — Peter J Bertheuaud
(74) *Attorney, Agent, or Firm* — Hamre, Schumann, Mueller & Larson, P.C.

(57) ABSTRACT

In the two-cylinder hermetic compressor, a main bearing is disposed on one surface of a first cylinder, an intermediate plate is disposed on another surface of the first cylinder, the intermediate plate is disposed on one surface of a second cylinder, and an auxiliary bearing is disposed on another surface of the second cylinder. A shaft is constituted by a main shaft portion which has a rotor attached thereto and is supported by the main bearing, a first eccentric portion having a first piston attached thereto, a second eccentric portion having a second piston attached thereto, and an auxiliary shaft portion supported by the auxiliary bearing. A thrust receiving portion is provided on a side of the second eccentric portion facing the auxiliary shaft portion, and the auxiliary bearing is provided with a thrust surface on which the end face of the thrust receiving portion slides while contacting therewith. The thrust surface is provided with a ring groove.

2 Claims, 4 Drawing Sheets

(51) Int. Cl.

| | |
|---|---|
| ***F04C 18/356*** | (2006.01) |
| ***F04C 27/00*** | (2006.01) |
| ***F01C 21/02*** | (2006.01) |
| ***F01C 21/10*** | (2006.01) |

(52) U.S. Cl.
CPC ..... *F04C 18/3564* (2013.01); *F04C 23/008* (2013.01); *F04C 27/008* (2013.01); *F04C 29/0021* (2013.01); *F04C 29/0057* (2013.01); *F04C 29/0085* (2013.01); *F04C 18/356* (2013.01); *F04C 2240/30* (2013.01); *F04C 2240/40* (2013.01); *F04C 2240/50* (2013.01); *F04C 2240/54* (2013.01); *F04C 2240/56* (2013.01); *F04C 2240/60* (2013.01); *F04C 2240/601* (2013.01); *F04C 2240/605* (2013.01); *Y10S 417/902* (2013.01)

(56) References Cited

U.S. PATENT DOCUMENTS

| | | | | |
|---|---|---|---|---|
| 4,726,739 | A * | 2/1988 | Saitou | F04C 18/3564 417/286 |
| 8,635,884 | B2 * | 1/2014 | Hirayama | F01C 21/0845 62/498 |
| 9,745,980 | B2 * | 8/2017 | Hirayama | F04C 23/008 |
| 2011/0067434 | A1 * | 3/2011 | Miura | F01C 21/02 62/498 |
| 2014/0219833 | A1 * | 8/2014 | Kanayama | F04C 29/0021 417/321 |
| 2014/0250937 | A1 * | 9/2014 | Hirayama | F04C 23/008 62/296 |

* cited by examiner

| Specification | Lower bearing | Shaft | | | |
|---|---|---|---|---|---|
| | Ring groove | Main shaft portion | Eccentric portion | | Auxiliary shaft portion |
| | | | Main shaft portion side | Auxiliary shaft portion side | |
| Comparative example | Not provided | ϕ24.0mm | ϕ36.3mm | ϕ36.3mm | ϕ24.0mm |
| Example | Provided | ↑ | ϕ35.0mm | ϕ35.0mm | ϕ22.6mm |

TWO-CYLINDER HERMETIC COMPRESSOR

BACKGROUND

1. Technical Field

The present disclosure relates to a two-cylinder hermetic compressor used for an outdoor unit of an air conditioner and a freezer.

2. Description of the Related Art

Generally, a hermetic compressor used for an outdoor unit of an air conditioner and a freezer includes an electric motor unit and a compressor mechanism unit in a sealed container. The electric motor unit and the compressor mechanism unit are connected to each other by a shaft, and a piston attached to an eccentric portion of the shaft revolves with the rotation of the shaft. A main bearing and an auxiliary bearing are mounted on both end faces of a cylinder having the piston provided therein, and the shaft is supported by the main bearing and the auxiliary bearing. In most cases, the diameter of the shaft is constant except for an eccentric portion.

On the other hand, PTL 1 (Unexamined Japanese Patent Publication No. 2008-14150) discloses a shaft having different diameters.

In PTL 1, the side on which the electric motor unit is provided with respect to the eccentric portion is defined as a main shaft portion, and the side opposite to the side on which the electric motor unit is provided is defined as an auxiliary shaft portion, wherein the diameter of the auxiliary shaft portion is set smaller than the diameter of the main shaft portion.

Note that, in PTL 1, a thrust load of the shaft is received by the lower end of the auxiliary shaft portion, except for the case in which a rolling bearing is provided on an auxiliary bearing.

Meanwhile, in a one-cylinder hermetic compressor that has conventionally been used most often, stress exerted from a compression chamber is received by a main shaft portion disposed on the side of an electric motor unit, so that stress received by an auxiliary shaft portion is extremely small.

Therefore, even if the diameter of the auxiliary shaft portion is set smaller than the diameter of the main shaft portion as disclosed in PTL 1, any problems hardly occur.

However, it has been shown as a result of an analysis that, in a two-cylinder hermetic compressor, stress exerted from each of compression chambers is dispersed into the main shaft portion and the auxiliary shaft portion, so that large stress is also applied on the auxiliary shaft portion.

SUMMARY

The present disclosure provides a two-cylinder hermetic compressor that can reduce maximum stress exerted on an auxiliary shaft portion to suppress an amount of sliding frictional wear on the auxiliary shaft portion.

Specifically, a two-cylinder hermetic compressor according to one example of an exemplary embodiment of the present disclosure is provided with a thrust receiving portion on a second eccentric portion on the side of an auxiliary shaft portion, an auxiliary bearing is provided with a thrust surface on which an end face of the thrust receiving portion slides while contacting therewith, and the thrust surface is formed with a ring groove.

Since the ring groove is formed on the thrust surface, maximum stress exerted on the auxiliary shaft portion is reduced, whereby an amount of sliding frictional wear on the auxiliary shaft portion can be suppressed.

In addition, in the two-cylinder hermetic compressor according to one example of the exemplary embodiment in the present disclosure, a ring-shaped edge portion formed by the ring groove and the thrust surface is beveled.

According to the configuration in which the ring-shaped edge portion formed by the ring groove and the thrust surface is beveled, abnormal wear on the end face of the thrust receiving portion can be suppressed.

In addition, in the two-cylinder hermetic compressor according to one example of the exemplary embodiment in the present disclosure, the end face of the auxiliary bearing on an inner periphery side with respect to the ring groove is formed to be lower than the end face of the auxiliary bearing on an outer periphery side with respect to the ring groove, and the end face of the auxiliary bearing on the outer periphery side with respect to the ring groove is defined as a thrust surface.

According to this configuration, the end face of the auxiliary bearing on the inner periphery side with respect to the ring groove is prevented from being in contact with the end face of the thrust receiving portion, whereby abnormal wear on the end face of the thrust receiving portion due to the ring-shaped edge portion of the auxiliary bearing on the inner periphery side with respect to the ring groove can be suppressed.

In addition, in the two-cylinder hermetic compressor according to one example of the exemplary embodiment in the present disclosure, the diameter of the auxiliary shaft portion is set smaller than the diameter of the main shaft portion.

According to the configuration in which the ring groove is formed on the thrust surface, maximum stress exerted on the auxiliary shaft portion can be reduced to suppress an amount of sliding frictional wear on the auxiliary shaft portion, whereby the diameter of the auxiliary shaft portion can be made smaller than the diameter of the main shaft portion. Since the diameter of the auxiliary shaft portion can be made smaller than the diameter of the main shaft portion, a sliding loss on the auxiliary shaft portion can further be reduced.

In addition, according to the configuration in which the thrust load of the shaft is received by the thrust surface of the auxiliary bearing through the end face of the thrust receiving portion of the shaft, even if the diameter of the auxiliary shaft portion is made smaller than the diameter of the main shaft portion, that is, even if the diameter of the auxiliary shaft portion is set smaller, it is unnecessary to decrease the area that receives the thrust load of the shaft, whereby the thrust load of the shaft can stably be received.

As described above, according to the present disclosure, maximum stress exerted on the auxiliary shaft portion can be reduced to suppress an amount of sliding frictional wear on the auxiliary shaft portion, in the two-cylinder hermetic compressor.

DETAILED DESCRIPTION

Hereinafter, a description will be given of an exemplary embodiment of the present disclosure with reference to the drawings.

Figure 1:
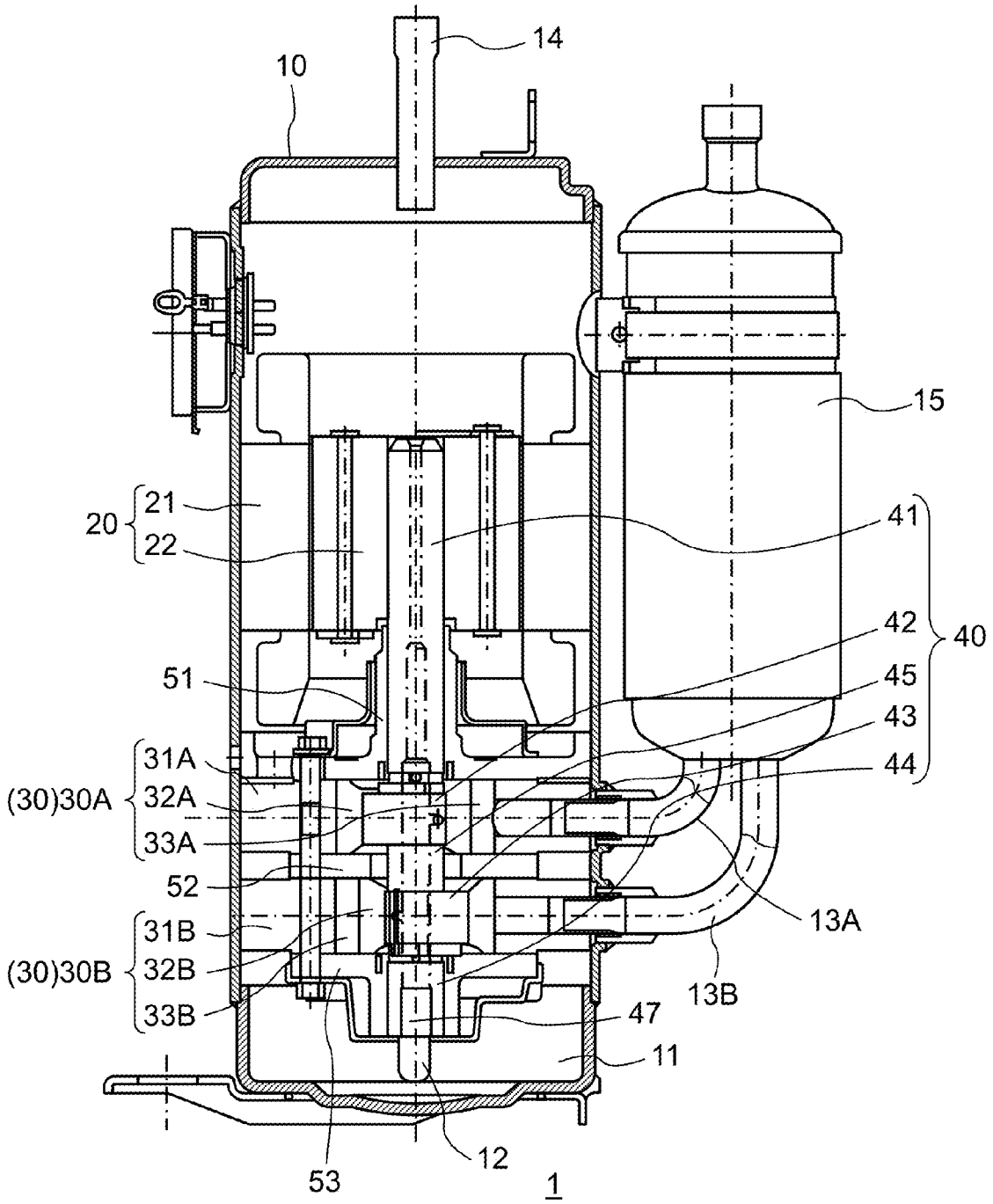
FIG. 1 is a sectional view of a two-cylinder hermetic compressor according to an exemplary embodiment of the present disclosure.

FIG. 1 is a sectional view of a two-cylinder hermetic compressor according to the exemplary embodiment of the present disclosure.

Two-cylinder hermetic compressor 1 according to the present exemplary embodiment includes electric motor unit 20 and compression mechanism unit 30 in sealed container 10. Electric motor unit 20 and compression mechanism unit 30 are connected to each other by shaft 40.

Electric motor unit 20 includes stator 21 fixed on an inner surface of sealed container 10 and rotor 22 rotating in stator 21.

Two-cylinder hermetic compressor 1 according to the present exemplary embodiment includes first compression mechanism unit 30A and second compression mechanism unit 30B as compression mechanism unit 30.

First compression mechanism unit 30A includes first cylinder 31A, first piston 32A disposed in first cylinder 31A, and a vane (not illustrated) that partitions the interior of first cylinder 31A. First compression mechanism unit 30A suctions a low-pressure refrigerant gas and compresses this refrigerant gas due to the revolution of first piston 32A in first cylinder 31A.

Similar to first compression mechanism unit 30A, second compression mechanism unit 30B includes second cylinder 31B, second piston 32B disposed in second cylinder 31B, and a vane (not illustrated) that partitions the interior of second cylinder 31B. Second compression mechanism unit 30B suctions a low-pressure refrigerant gas and compresses this refrigerant gas due to the revolution of second piston 32B in second cylinder 31B.

Main bearing 51 is disposed on one surface of first cylinder 31A, and intermediate plate 52 is disposed on another surface of first cylinder 31A.

In addition, intermediate plate 52 is disposed on one surface of second cylinder 31B, and auxiliary bearing 53 is disposed on another surface of second cylinder 31B.

That is to say, intermediate plate 52 partitions first cylinder 31A and second cylinder 31B. Intermediate plate 52 has an opening larger than the diameter of shaft 40.

Shaft 40 is constituted by main shaft portion 41 which has rotor 22 attached thereto and is supported by main bearing 51, first eccentric portion 42 having first piston 32A attached thereto, second eccentric portion 43 having second piston 32B attached thereto, and auxiliary shaft portion 44 supported by auxiliary bearing 53.

First eccentric portion 42 and second eccentric portion 43 are formed to have a phase difference of 180 degrees, and connection shaft portion 45 is formed between first eccentric portion 42 and second eccentric portion 43.

First compression chamber 33A is formed between main bearing 51 and intermediate plate 52 and between the inner peripheral surface of first cylinder 31A and the outer peripheral surface of first piston 32A. In addition, second compression chamber 33B is formed between intermediate plate 52 and auxiliary bearing 53 and between the inner peripheral surface of second cylinder 31B and the outer peripheral surface of second piston 32B.

The volume of first compression chamber 33A and the volume of second compression chamber 33B are the same. Specifically, the inner diameter of first cylinder 31A and the inner diameter of second cylinder 31B are the same, and the outer diameter of first piston 32A and the outer diameter of second piston 32B are the same. In addition, the height of first cylinder 31A on the inner periphery thereof and the height of second cylinder 31B on the inner periphery thereof are the same, and the height of first piston 32A and the height of second piston 32B are the same.

Oil reservoir 11 is formed at the bottom of sealed container 10, and oil pickup 12 is provided at the lower end of shaft 40.

In addition, oil feed path 47 is formed inside shaft 40 in the axial direction, and a communication path for feeding oil to a sliding surface of compression mechanism unit 30 is formed in oil feed path 47.

First suction pipe 13A and second suction pipe 13B are connected to the side surface of sealed container 10, and discharge pipe 14 is connected to the top of sealed container 10.

First suction pipe 13A is connected to first compression chamber 33A, and second suction pipe 13B is connected to second compression chamber 33B, respectively. Accumulator 15 is provided at the upstream side of first suction pipe 13A and second suction pipe 13B. Accumulator 15 separates the refrigerant returning from a freezing cycle into a liquid refrigerant and a gas refrigerant. The gas refrigerant flows through first suction pipe 13A and second suction pipe 13B.

Due to the rotation of shaft 40, first piston 32A and second piston 32B revolve in first compression chamber 33A and second compression chamber 33B, respectively.

The gas refrigerant suctioned from first suction pipe 13A and second suction pipe 13B into first compression chamber 33A and second compression chamber 33B is compressed in first compression chamber 33A and second compression chamber 33B due to the revolution of first piston 32A and second piston 32B, and then, discharged into sealed container 10. While the gas refrigerant discharged into sealed container 10 rises through electric motor unit 20, oil is separated therefrom, and then, the resultant gas refrigerant is discharged outside of sealed container 10 from discharge pipe 14.

The oil sucked from oil reservoir 11 due to the rotation of shaft 40 is fed into compression mechanism unit 30 from the communication path to allow the sliding surface of compression mechanism unit 30 to be smooth.

Figure 2:
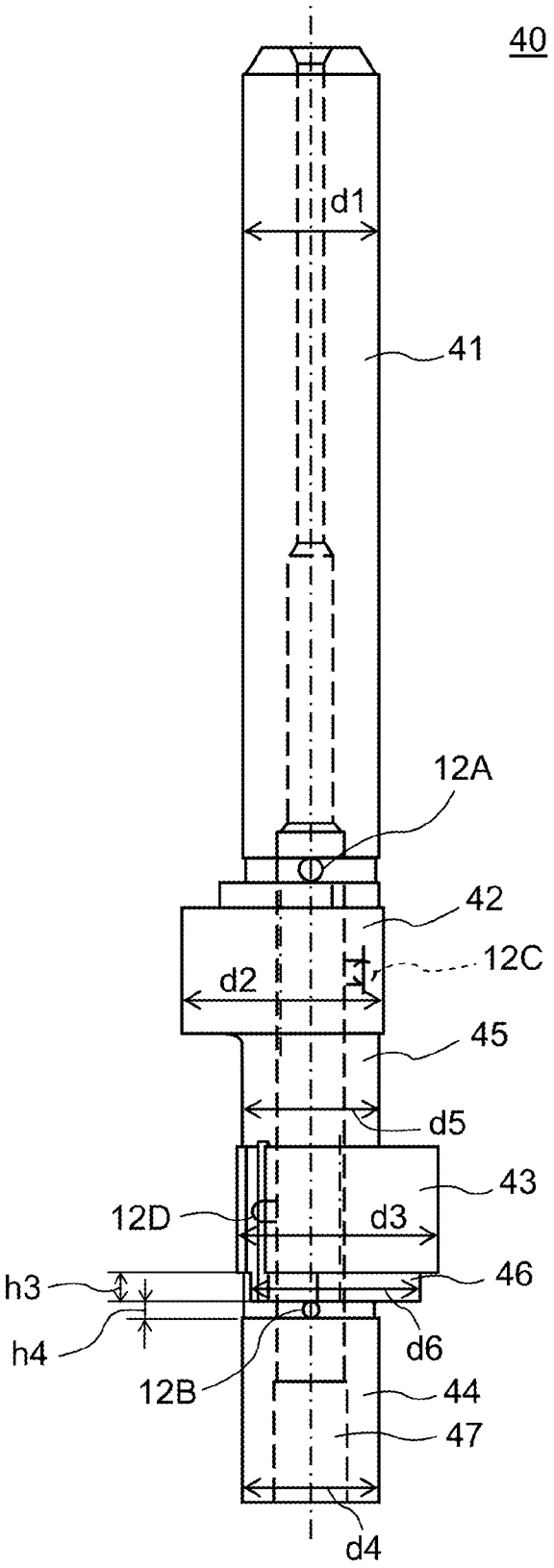
FIG. 2 is a side view of a shaft used in the two-cylinder hermetic compressor according to the exemplary embodiment of the present disclosure.
Figures 3, 4:
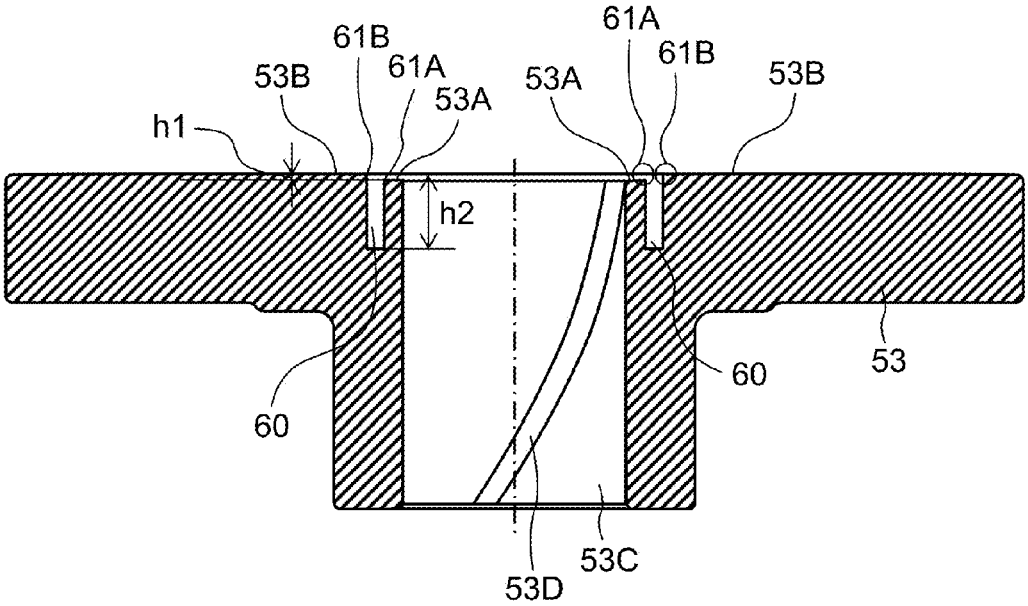
FIG. 3 is a side sectional view of an auxiliary bearing used in the two-cylinder hermetic compressor according to the exemplary embodiment of the present disclosure.
FIG. 4 is a diagram illustrating specifications of Example and Comparative Example used for the test of maximum stress values on an auxiliary shaft portion in the two-cylinder hermetic compressor according to the exemplary embodiment of the present disclosure.

FIG. 2 is a side view of the shaft used in the two-cylinder hermetic compressor according to the exemplary embodiment of the present disclosure, and FIG. 3 is a side sectional view of the auxiliary bearing used in the two-cylinder hermetic compressor according to the exemplary embodiment of the present disclosure.

As illustrated in FIG. 2, shaft 40 is constituted by main shaft portion 41, first eccentric portion 42, second eccentric portion 43, auxiliary shaft portion 44, and connection shaft portion 45. Thrust receiving portion 46 is provided on a side of second eccentric portion 43 facing auxiliary shaft portion 44.

As illustrated in FIG. 3, auxiliary bearing 53 is provided with thrust surfaces 53A, 53B on which the end face of thrust receiving portion 46 illustrated in FIG. 2 slides while contacting therewith. Thrust surfaces 53A, 53B are provided with ring groove 60. Thrust surface 53A is defined by the end face of auxiliary bearing 53 on an inner periphery side with respect to ring groove 60, and thrust surface 53B is defined by the end face of auxiliary bearing 53 on an outer periphery side with respect to ring groove 60.

According to the configuration in which ring groove 60 is formed on thrust surfaces 53A, 53B, maximum stress exerted on auxiliary shaft portion 44 is reduced, whereby an amount of sliding frictional wear on auxiliary shaft portion 44 can be suppressed.

It is preferable that ring-shaped edge portions 61A, 61B formed by ring groove 60 and thrust surfaces 53A, 53B are beveled. Note that ring-shaped edge portion 61A is an inner peripheral edge of ring groove 60, and ring-shaped edge portion 61B is an outer peripheral edge of ring groove 60.

According to the configuration in which ring-shaped edge portions 61A, 61B formed by ring groove 60 and thrust surfaces 53A, 53B are beveled, abnormal wear on the end face of thrust receiving portion 46 can be suppressed.

In addition, it is preferable that the end face (thrust surface 53A) of auxiliary bearing 53 on the inner periphery side with respect to ring groove 60 is formed to be lower than the end face (thrust surface 53B) of auxiliary bearing 53 on the outer periphery side with respect to ring groove 60 by h1 (step h1), the end face of thrust receiving portion 46 is prevented from being contact with thrust surface 53A, and the end face (thrust surface 53B) of auxiliary bearing 53 on the outer periphery side with respect to ring groove 60 is defined as a thrust surface. Step h1 between thrust surface 53A and thrust surface 53B is smaller than depth h2 of ring groove 60.

The configuration in which the end face of auxiliary bearing 53 on the inner periphery side with respect to ring groove 60 is prevented from being in contact with the end face of thrust receiving portion 46 can prevent abnormal wear on the end face of thrust receiving portion 46 caused by ring-shaped edge portion 61A of auxiliary bearing 53 on the inner periphery side with respect to ring groove 60.

If the diameter of main shaft portion 41 is defined as d1, the diameter of first eccentric portion 42 is defined as d2, the diameter of second eccentric portion 43 is defined as d3, the diameter of auxiliary shaft portion 44 is defined as d4, and the diameter of connection shaft portion 45 is defined as d5, diameter d4 of auxiliary shaft portion 44 is set smaller than diameter d1 of main shaft portion 41.

In addition, diameter d6 of thrust receiving portion 46 is set smaller than diameter d3 of second eccentric portion 43, and larger than diameter d1 of main shaft portion 41, diameter d5 of connection shaft portion 45, and diameter d4 of auxiliary shaft portion 44.

According to the configuration in which ring groove 60 is formed on thrust surfaces 53A, 53B as described above, maximum stress exerted on auxiliary shaft portion 44 can be reduced. Thus, diameter d4 of auxiliary shaft portion 44 can be made smaller than diameter d1 of main shaft portion 41, whereby a sliding loss on auxiliary shaft portion 44 can be reduced.

Notably, if diameter d4 of auxiliary shaft portion 44 is set smaller as described above in the configuration in which the thrust load of shaft 40 is received by auxiliary shaft portion 44, the area that receives the thrust load of shaft 40 becomes small, so that the load cannot stably be received.

However, according to the configuration in which the thrust load of shaft 40 is received on thrust surfaces 53A, 53B of auxiliary bearing 53 through the end face of thrust receiving portion 46 as in two-cylinder hermetic compressor 1 according to the present exemplary embodiment, even if diameter d4 of auxiliary shaft portion 44 is made smaller than diameter d1 of main shaft portion 41, that is, even if diameter d4 of auxiliary shaft portion 44 is set smaller, it is unnecessary to decrease the area that receives the thrust load of shaft 40, whereby the thrust load of shaft 40 can stably be received.

As illustrated in FIG. 2, first communication path 12A which is in communication with oil feed path 47 formed inside shaft 40 is open at the end of main shaft portion 41 on the side of first eccentric portion 42, and second communication path 12B which is in communication with oil feed path 47 formed inside shaft 40 is open at the end of auxiliary shaft portion 44 on the side of second eccentric portion 43.

The diameter is set to be smaller than diameter d1 of main shaft portion 41 on the position where first communication path 12A is open, and the diameter is set to be smaller than diameter d4 of auxiliary shaft portion 44 on the position where second communication path 12B is open, whereby oil can be reliably fed to compression mechanism unit 30.

Third communication path 12C which is in communication with oil feed path 47 formed inside shaft 40 is open at the side surface of first eccentric portion 42, and fourth communication path 12D which is in communication with oil feed path 47 formed inside shaft 40 is open at the side surface of second eccentric portion 43.

Note that, in the configuration in which the thrust load of shaft 40 is received by auxiliary shaft portion 44, the thrust load of shaft 40 is received by the area of auxiliary shaft portion 44 excluding the area of oil feed path 47, because oil feed path 47 is formed inside shaft 40. In the present exemplary embodiment, the thrust load of shaft 40 is received on the end face of thrust receiving portion 46. Therefore, even if diameter d4 of auxiliary shaft portion 44 is made smaller than diameter d1 of main shaft portion 41, that is, even if diameter d4 of auxiliary shaft portion 44 is set smaller, it is unnecessary to decrease the area that receives the thrust load of shaft 40, whereby the thrust load of shaft 40 can stably be received.

Notably, if the height of thrust receiving portion 46 is defined as h3, and the height of a shaft diameter portion, which has a diameter smaller than diameter d4 of auxiliary shaft portion 44 and on which second communication path 12B is open, is defined as h4, height h4 of the shaft diameter portion is larger than step h1 between thrust surface 53A and thrust surface 53B, and depth h2 of ring groove 60 is larger than height h4 of the shaft diameter portion.

In addition, oil groove 53D for guiding oil is formed on inner peripheral surface 53C of auxiliary bearing 53 on which the outer peripheral surface of auxiliary shaft portion 44 slides.

Figure 5:
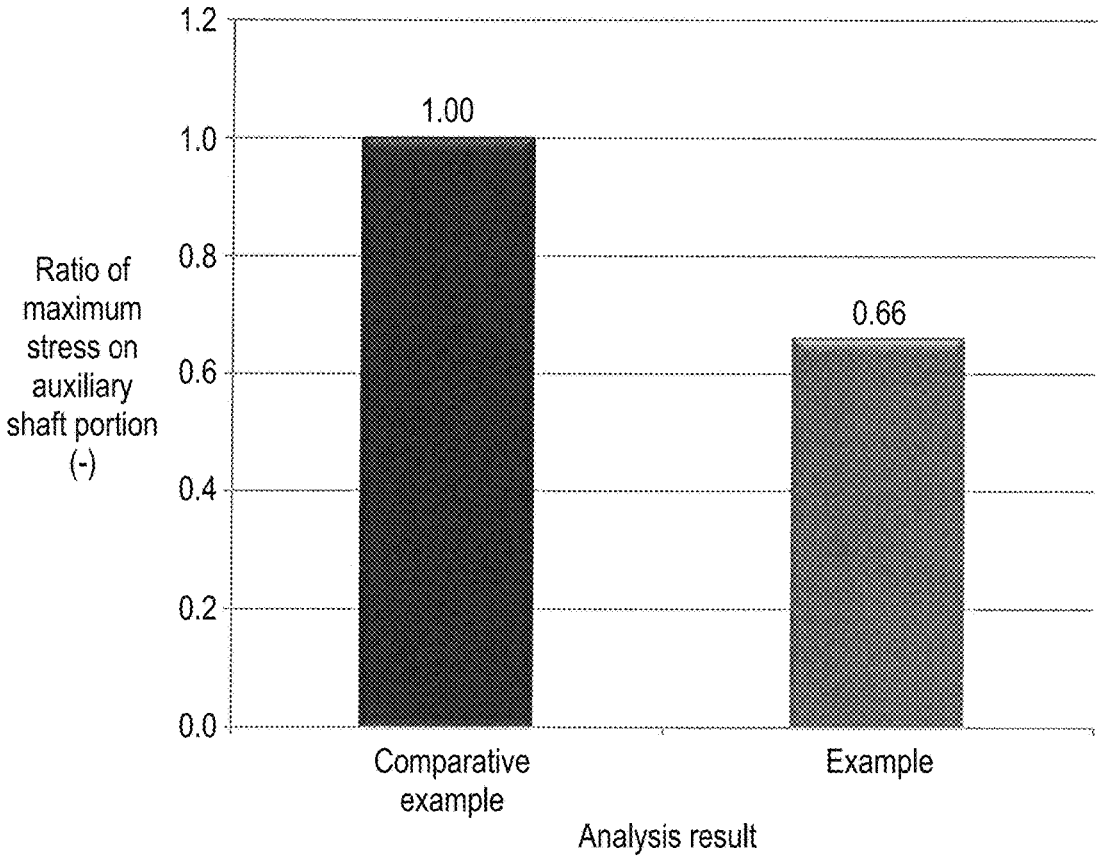
FIG. 5 is a graph showing the test result of maximum stress values on auxiliary shaft portions in Example and Comparative Example shown in FIG. 4.
Figure 6:
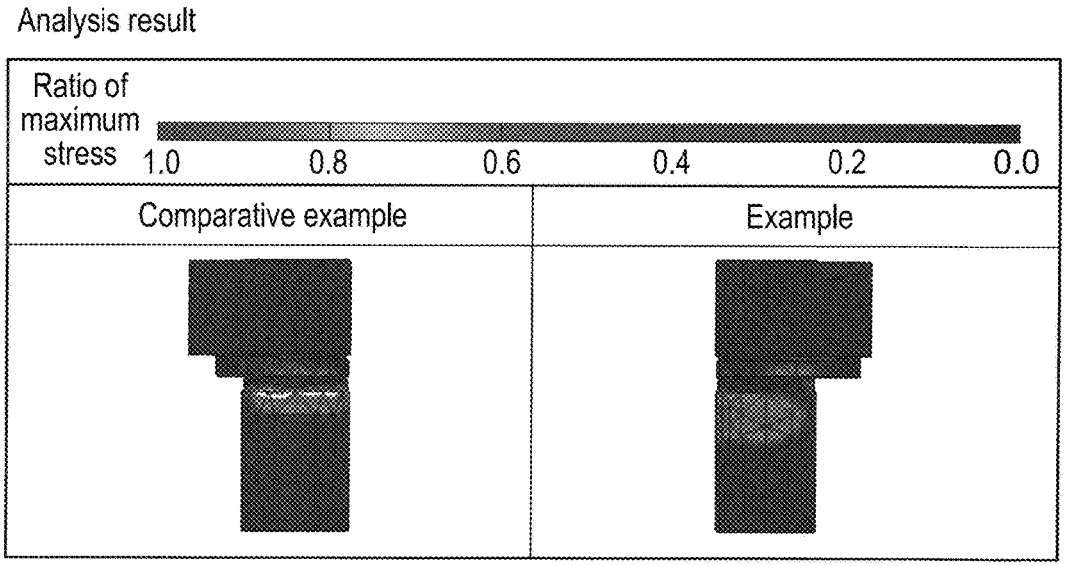
FIG. 6 is an analysis diagram showing a stress distribution on auxiliary shaft portions in Example and Comparative Example shown in FIG. 4.

FIGS. 4 to 6 illustrate test results of maximum stress values on the auxiliary shaft portion in the two-cylinder hermetic compressor according to the exemplary embodiment of the present disclosure.

FIG. 4 shows specifications of Comparative Example in which diameter d1 of main shaft portion 41 and diameter d4 of auxiliary shaft portion 44 are the same and ring groove 60 is not formed, and Example in which diameter d4 of auxiliary shaft portion 44 is set smaller than diameter d1 of main shaft portion 41 and ring groove 60 is formed.

In Example, diameter d4 of auxiliary shaft portion 44 is set to be 94% with respect to diameter d1 of main shaft portion 41.

FIG. 5 is a graph showing the test result of maximum stress values on auxiliary shaft portions 44 in Comparative Example and Example, and FIG. 6 is an analysis diagram showing a stress distribution on auxiliary shaft portions 44 in Comparative Example and Example.

As shown in FIG. 5, in Example in which ring groove 60 is formed in contrast to Comparative Example, maximum stress value is lowered by 34%, in spite of setting diameter d4 of auxiliary shaft portion 44 to be smaller than diameter d1 of main shaft portion 41.

While the present disclosure describes a two-cylinder hermetic compressor, it is also applicable to a compressor provided with a plurality of, such as three or more, cylinders.

What is claimed is:

1. A two-cylinder hermetic compressor comprising:

an electric motor unit and a compression mechanism unit in a sealed container, wherein the electric motor unit and the compression mechanism unit are connected to each other by a shaft, the electric motor unit includes a stator fixed on an inner surface of the sealed container and a rotor that rotates in the stator, a first compression mechanism unit and a second compression mechanism unit are provided as the compression mechanism unit, the first compression mechanism unit includes a first cylinder and a first piston provided in the first cylinder, the second compression mechanism unit includes a second cylinder and a second piston provided in the second cylinder, a main bearing is disposed on one surface of the first cylinder and an intermediate plate is disposed on another surface of the first cylinder, the intermediate plate is disposed on one surface of the second cylinder and an auxiliary bearing is disposed on another surface of the second cylinder, the shaft includes a main shaft portion which is supported by the main bearing and to which the rotor is attached, a first eccentric portion to which the first piston is mounted, a second eccentric portion to which the second piston is mounted, and an auxiliary shaft portion supported by the auxiliary bearing, a thrust receiving portion is provided on a side of the second eccentric portion facing the auxiliary shaft portion, the auxiliary bearing is provided with a thrust surface on which an end face of the thrust receiving portion slides while the end face is contacting the thrust surface, and the thrust surface is formed with a ring groove, wherein an end face of the auxiliary bearing on an inner periphery side with respect to the ring groove is formed to be lower than an end face of the auxiliary bearing on an outer periphery side with respect to the ring groove, and the end face of the auxiliary bearing on the outer periphery side with respect to the ring groove is defined as the thrust surface.

2. The two-cylinder hermetic compressor according to claim 1, wherein a ring-shaped edge portion formed by the ring groove and the thrust surface is beveled.

* * * * *